US005122770A

United States Patent [19]

Held

[11] Patent Number: 5,122,770

[45] Date of Patent: Jun. 16, 1992

[54] ALTERNATING CURRENT CONTACTOR

[75] Inventor: Kurt Held, Amberg, Fed. Rep. of Germany

[73] Assignee: Siemens Aktiengesellschaft, Berlin & Munich, Fed. Rep. of Germany

[21] Appl. No.: 626,754

[22] Filed: Dec. 13, 1990

[30] Foreign Application Priority Data

Dec. 13, 1989 [EP] European Pat. Off. ..... 89123031.0

[51] Int. Cl.[5] ..... H01H 67/02

[52] U.S. Cl. ..... 335/128; 335/277; 335/271

[58] Field of Search ..... 335/193, 248, 128, 277, 335/271, 78-85

[56] References Cited

U.S. PATENT DOCUMENTS

| | | | |
|---|---|---|---|
| 3,014,103 | 12/1961 | Moran et al. | 335/193 |
| 3,109,904 | 11/1963 | Koertge et al. | 335/193 |
| 3,693,125 | 9/1972 | Prouty | 335/277 |
| 4,625,194 | 11/1986 | Held . | |

FOREIGN PATENT DOCUMENTS

| | | |
|---|---|---|
| 1231786 | 1/1967 | Fed. Rep. of Germany . |
| 1790197 | 1/1972 | Fed. Rep. of Germany . |
| 1765237 | 2/1972 | Fed. Rep. of Germany . |
| 0174467 | 3/1986 | Fed. Rep. of Germany . |
| 0987748 | 3/1965 | United Kingdom . |

*Primary Examiner*—Leo P. Picard
*Assistant Examiner*—Lincoln Donovan
*Attorney, Agent, or Firm*—Kenyon & Kenyon

[57] ABSTRACT

An alternating current contactor has an armature to be actutated by a magnet system. The armature is operatively connected to a return spring-loaded contact base holding movable contact parts of the contact system. The contact base is here provided with a supplementary mass and brought into operative connection with the armature via a coupling spring, the supplementary mass being movable relative to the contact base and an additionally provided intermediate part to which the armature is coupled. The coupling spring, taking support on the contact base on the one hand, can, on the other hand, bear against an angularly bent end of the intermediate part which is pressed against the supplementary mass. The supplementary mass is applied against a stop at the contact base or being spring-loaded through a separate supplementary spring counter to the direction of movement of the contact base against a stop at the contact base. Friction elements affecting the free movement engage at the supplementary mass, so that a delay of the supplementary mass corresponding to the friction behavior can be achieved. Thereby, the general sensitivity of a magnet system in the case of uneven pole faces to the closing behavior is considerably reduced. This is of special advantage when a contactor can be optimal at 50 and 60 Hz line frequency.

8 Claims, 5 Drawing Sheets

ALTERNATING CURRENT CONTACTORcl

BACKGROUND OF THE INVENTION

The present invention relates to an alternating current contactor and in particular to a contactor with an armature actuated by a magnet system, the armature being in operative connection, through a coupling spring, with a return spring-loaded contact base holding the movable contact parts of the contact system, and the contact base being provided with a supplementary mass which is pressed in a direction, against a stop on the contact base by a supplementary spring, opposite to the closing direction of the contact.

An alternating current contactor is known from European Patent Application 0174467. Through the arrangement of the supplementary mass in conjunction with the spring a relatively good rebound damping is indeed obtained. However, a swing-back of the contact base will occur, owing to which the latter may strike the armature several times. Thus, it cannot be avoided that this impingement falls time wise into the range of the stationary holding force trough at 50 or 60 Hz line frequency, and this may cause a ripping open of the already closed magnet system.

SUMMARY OF THE INVENTION

The present invention provides improved rebound damping. This is achieved in a simple manner by the fact that a means frictionally engages the supplementary mass of the mass for affecting the free movement of the mass. The delay of the supplementary mass thereby occurs in both directions. In the case of strong closing impacts, a rebound damping is thereby achieved, so that in critical phase positions practically no swing-back of the contact base occurs.

In the present invention, the general sensitivity of a magnet system in case of uneven pole faces to the closing behavior is considerably reduced. This is of special advantage when a contactor is used at 50 and 60 Hz line frequency, because normally a system can be optimal only for one frequency.

A simple construction for the means for affecting the supplementary mass movement without separate supplementary parts results if the means includes a prestressed cover which by some of its parts presses on the supplementary mass. The means can also be realized as a commercial part, in which case a special from of the cover is not needed if the means includes a silicone rubber tube which, held either in a groove in the contact base or in the supplementary mass, presses against the other part. The delay of the supplementary mass can be determined still better if the means includes a convexly curved leaf spring held on the contact base, the convex part of which is pressed into a corresponding recess in the supplementary mass. This results in a progression of the friction effect from the starting position in both directions of movement of the contact base. A normal smooth leaf spring will do to obtain the progressive friction force if the means includes a supplementary mass rotatable about an axis at the contact base, where the mass is elliptically formed opposite the pivot point, and is in contact against a leaf spring that is supported in the contact base and extends in the direction of movement of the contact base.

Another simple cost-effective embodiment of the present invention results if the means comprises an angle spring whose angle is supported on the contact base and has a first leg pressing against a side of the supplementary mass extending parallel to the direction of movement and has a second leg forming a supplementary spring.

DETAILED DESCRIPTION

Figure 1:
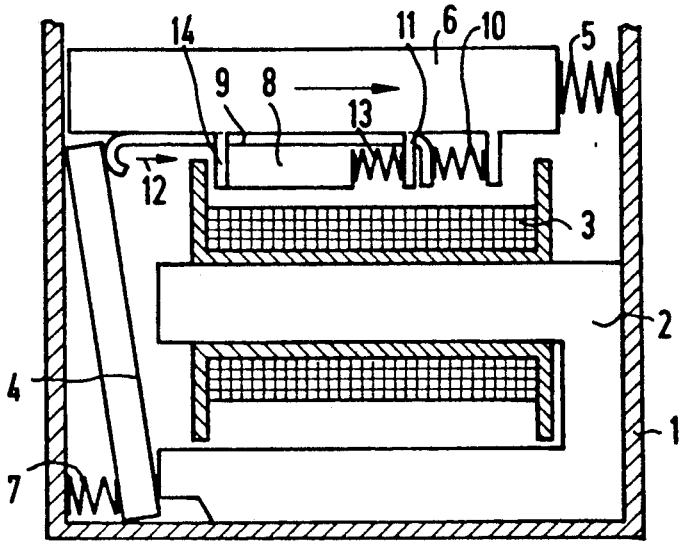
FIG. 1 shows a schematic representation of an alternating current contractor with supplementary mass and spring arrangement.

The alternating current contactor represented in FIG. 1 has a housing 1, in which are mounted the magnet system with a core 2 of a coil 3 as well as an armature 4 and a contact base 6 spring-loaded by a return spring 5. The armature 4 is designed as a folding armature is pressed by a spring 7 against one leg of the core. At the other end on its other side armature 4 is in contact against an intermediate slide 9 which is movable relative to the contact base 6 via a coupling spring 10. The intermediate slide 9 is pressed against stops 11 of the contact base. The direction of attack of the armature is indicated by an arrow 12. The supplementary mass 8 is pressed against the stop 14 at the contact base 6 by the supplementary spring 13 in a direction opposite to the direction of movement of the contact base 6 in closing sense.

Figure 2:
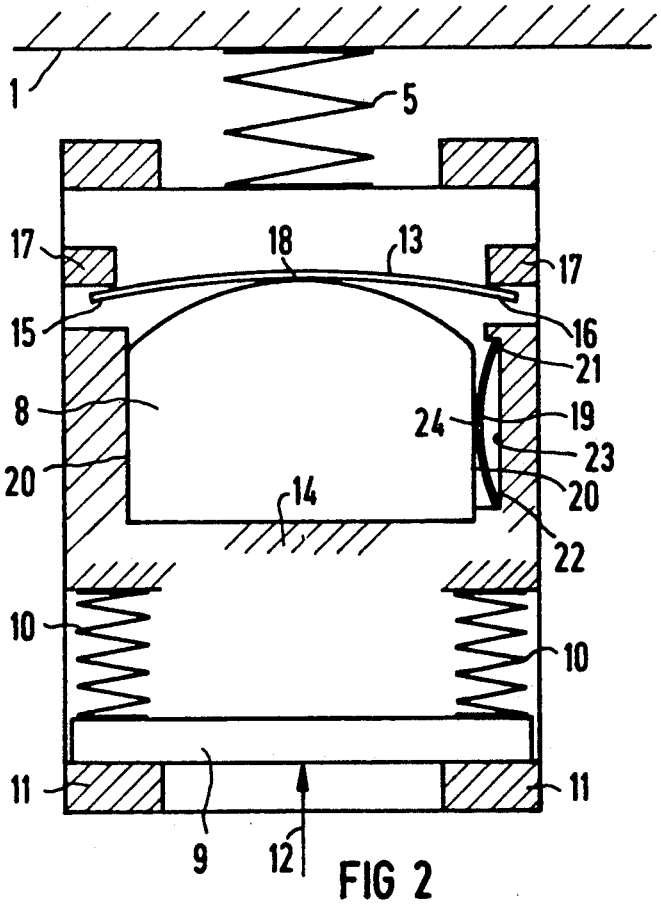
FIGS. 2, 3 *3a* and 4 illustrate a contact base with supplementary mass and friction springs according to an embodiment of the present invention which act in a linear manner.

In the embodiment of FIG. 2, spring 13 is designed as a leaf spring. The free ends 15, 16 of the leaf spring brace against the projections 17 of the contact base 6. The bearing surface of the supplementary mass 8 at the supplementary spring 13 is labeled 18 in FIG. 2. Additionally, according to this embodiment of the present invention, a friction spring 19 is provided, which engages the side faces 20 of the supplementary mass 8 and extends parallel to the direction of movement of that mass. The free ends 21, 22 of the friction spring 19 brace against a correspondingly designed protuberance 23 of the contact base 6. Upon movement of the supplementary mass 8 in the direction of arrow 12, the cambered face 24 of the friction spring 19 exerts a frictional action on the supplementary mass 8, so that during the forward, as well as the return movement, a delay is achieved which delays the rebound of the contact base 6.

Figure 3:
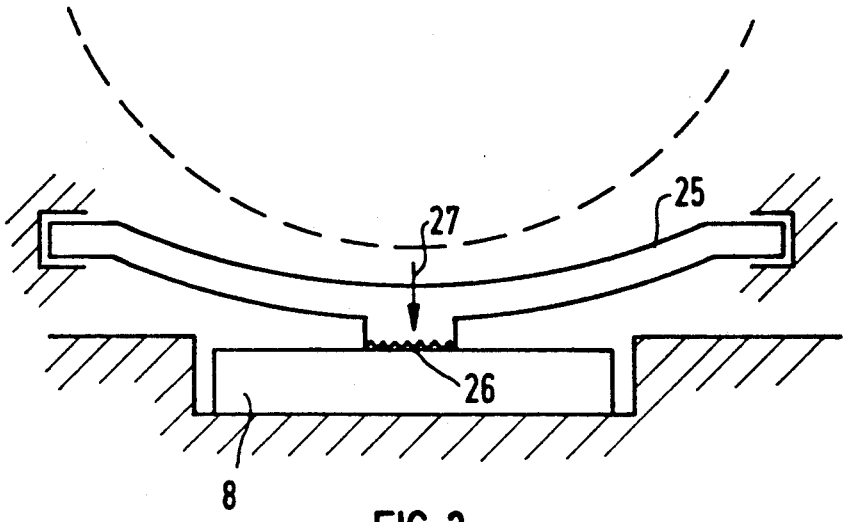
Figure 3A:
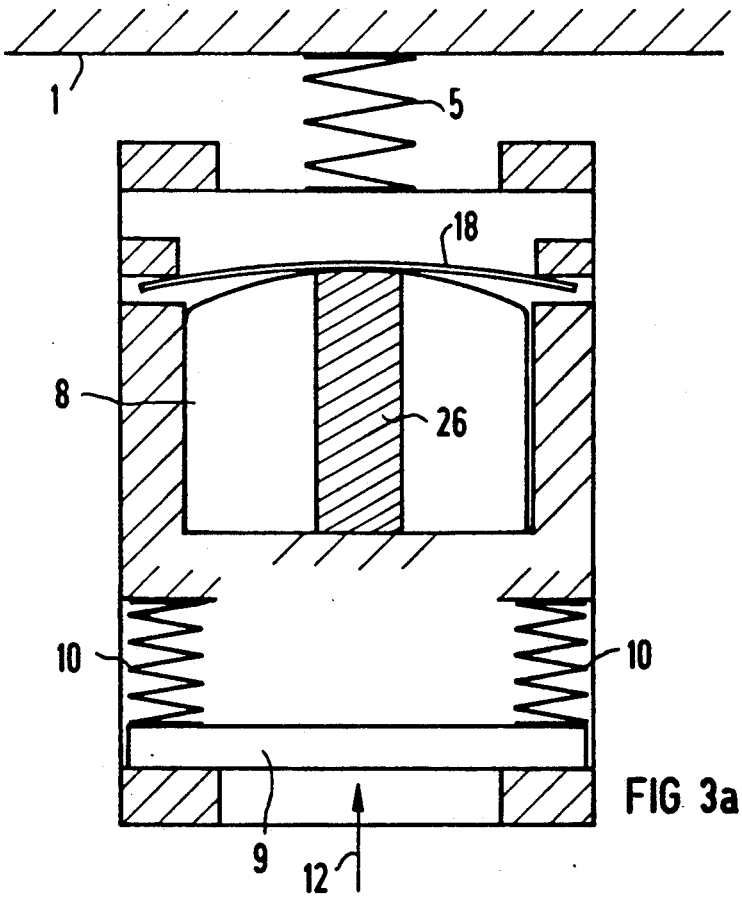

In the embodiment of FIGS. 3 and *3a*, the damping friction is obtained through a prestressed cover 25 instead of the friction spring 19. The friction face 26 at a protuberance 27 of cover 25 bears against one of the side faces of the supplementary mass 8. Otherwise, suspension of the supplementary mass is as in the embodiment of FIG. 2, without the lateral friction spring.

Figure 4:
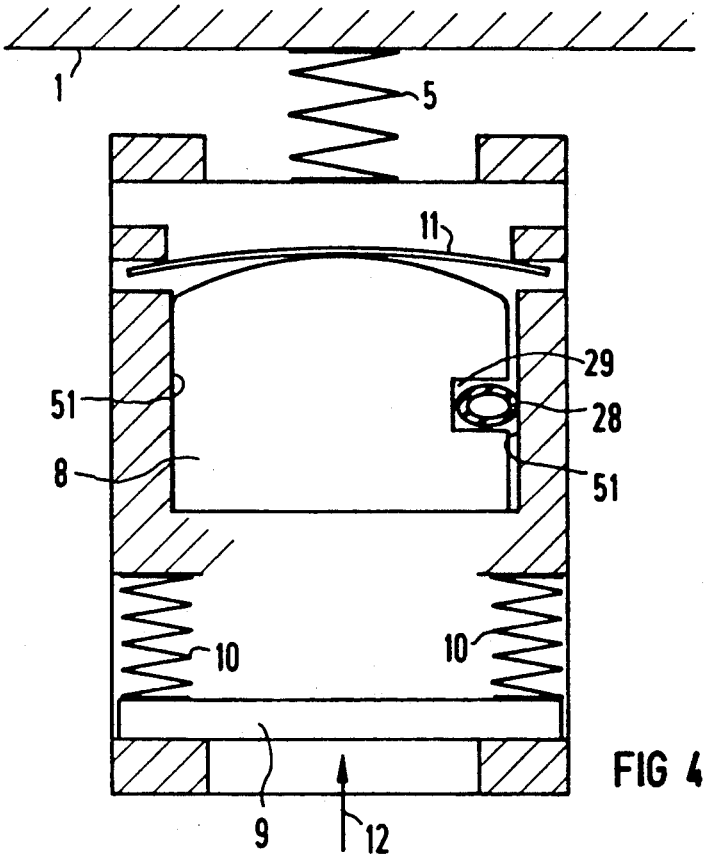

In the embodiment of FIG. 4, a vibration damping of the supplementary mass 8 is achieved through a suitable silicone rubber tube 28, which is inserted in a groove 29 in the supplementary mass 8. The silicone tube 28, which can be bought by the yard as a wear-resistant article, bears against one side face 51 of the contact base, whereas by its other end the supplementary mass applies against the other side face 51 of the contact base. The supplementary mass here executes additionally a slight rotary movement, which has a favorable effect on the delay time and on the damping. Alternatively, the silicone tube can be disposed in a groove in the contact base and bear against one side face of the supplementary mass.

Figure 5:
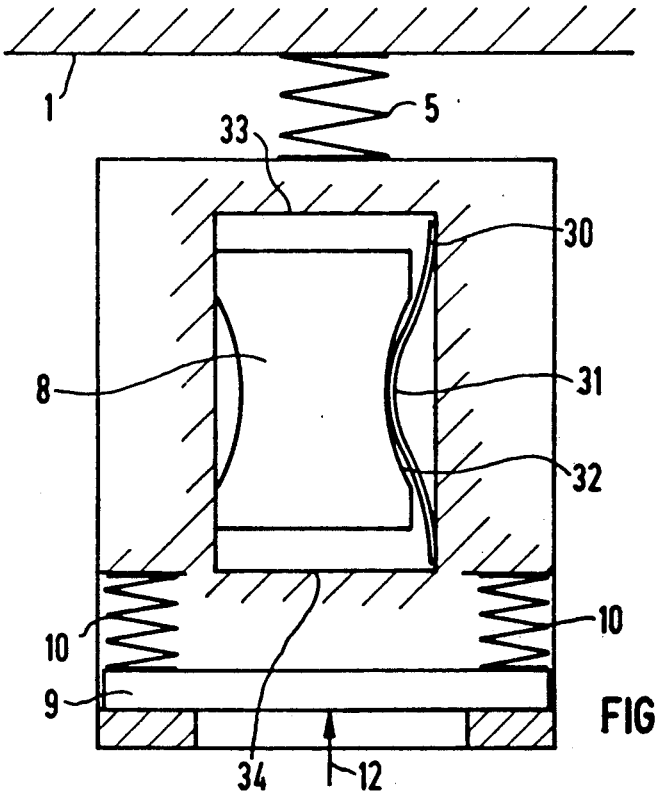
FIGS. 5, 6 and 7 illustrate contact base designs according to an embodiment of the present invention where friction force acts progressively in the switching process.

In the embodiment of FIG. 5, a progressive friction force is produced through a lateral leaf spring 30 which has a convexly curved part 31 which engages in a corresponding recess 32 of the supplementary mass 8. By the engagement of the convex part 31 into the recess 32, the supplementary mass 8 is held in a middle position. Since in this example, the leaf spring 13 can be dispensed with, path limiting stops 33, 34 are present. As soon as the supplementary mass moves out of the middle position, a progressive friction force is generated through the convex part 31 of the lateral leaf spring 30. Here too there results a time delay for bridging the dynamic holding force trough, and through the damping, via the increased friction repeated impingement of the contact base on the armature is avoided.

Figure 6:
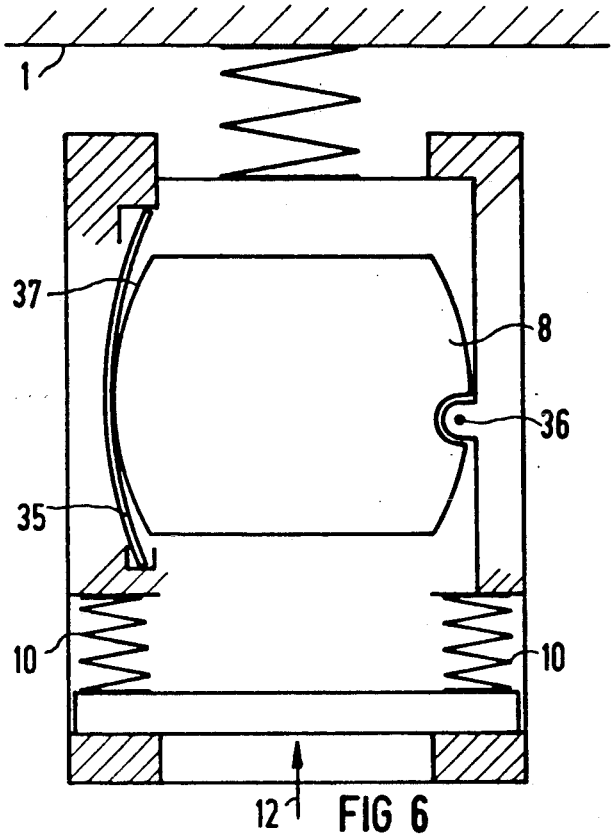

In the embodiment of FIG. 6, on one side of the supplementary mass 8 a prestressed leaf spring 35 is provided, which by its free end bears against the contact base 6 and extends in the direction of movement of the contact base. Opposite the leaf spring, the supplementary mass 8 is rotatably mounted on the contact base through an axle 36. The face 37 of the supplementary mass 8 opposite the axle 36 is substantially of elliptical design, i.e., the radius in the end region of the supplementary mass 8 is greater than the radius in the central part of the mass, so that with increasing rotation movement of the mass in both directions the friction or coupling force, which is transmitted from the supplementary mass 8 to the contact base 6, increases. Thereby both the required time delay and the vibration damping of the supplementary mass 8 are achieved, so that again a satisfactory operation of the contractor drive exists at 50 and 60 Hz line frequency.

Figure 7:
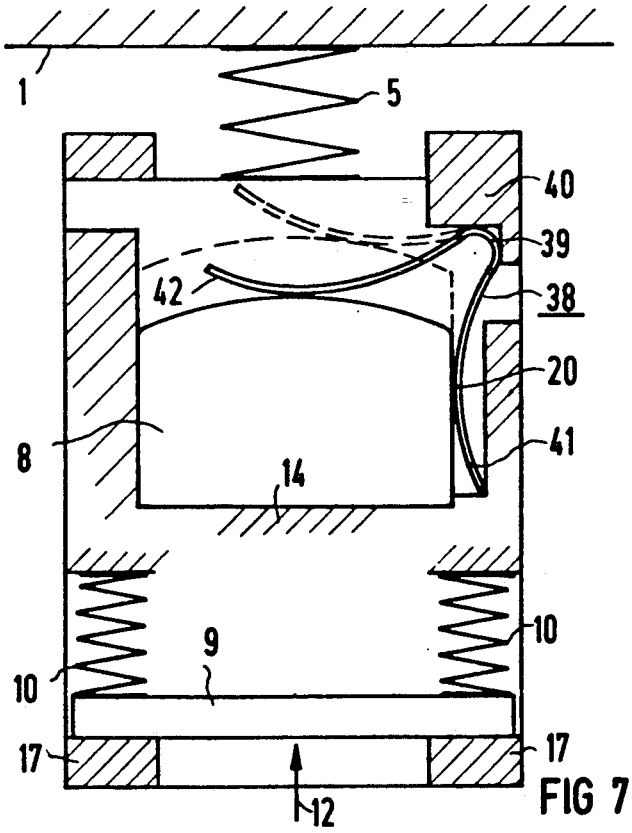

In the embodiment of FIG. 7, instead of friction spring 22, there is an angle spring 38, the angle 39 of which is braced in a recess of the protuberance 40 at the contact base 6. One leg 41 of the angle spring 38 creates the friction effect, as described for spring 22, at the side face 20 of the supplementary mass 8. The other leg 42 assumes the function of the leaf spring 18. As can be seen, shown by a first dashed line in FIG. 7, the force of the first leg 41 onto the side face 23 is increased when leg 42 is brought into the dashed position.

Figure 8:
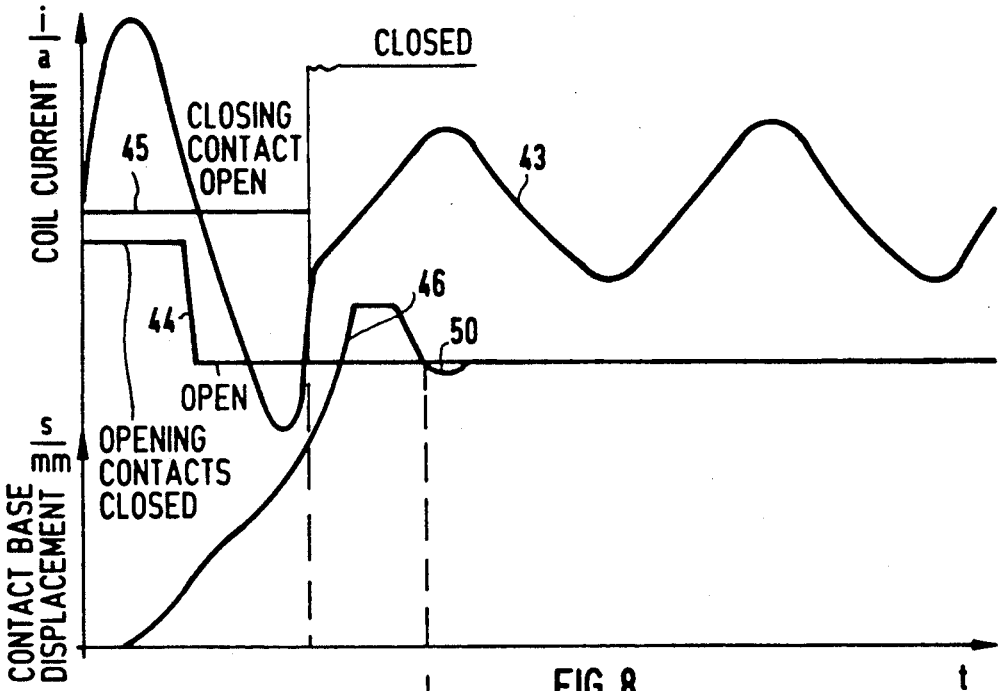
FIG. 8 is a diagram showing the current response in the magnet system versus time, the displacement of the contact base versus time, and the state of an opening and closing contact versus time.
Figure 9:
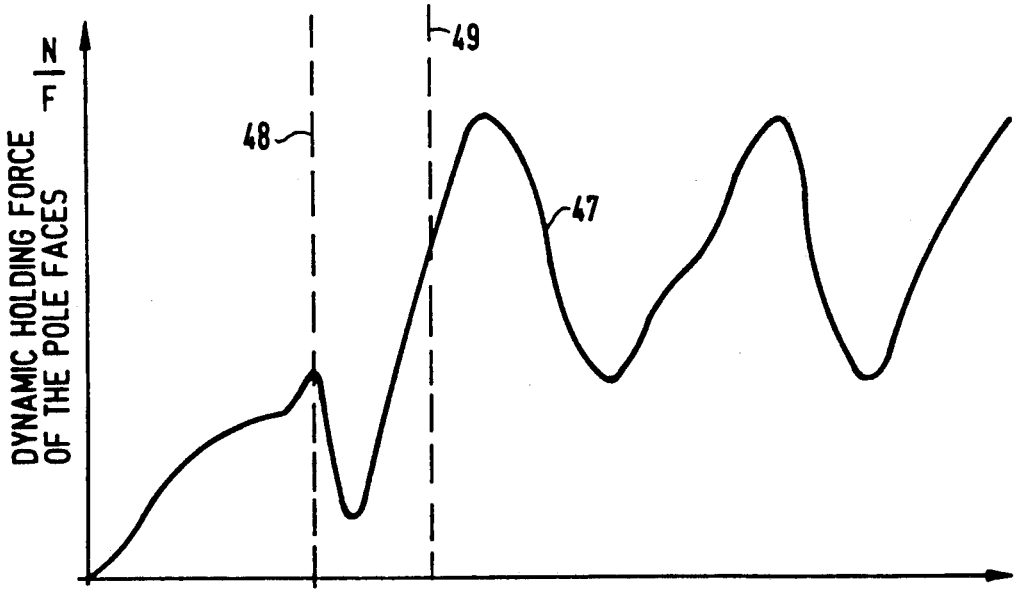
FIG. 9 is a diagram showing the dynamic holding force of the magnet parts associated with the diagram per FIG. 8 versus time.

FIGS. 8 and 9 show the current response in the magnet system, which is labeled 43. The line which represents the timing of the opening and closing function is designated by 44 and 45. The displacement of the contact base 6 over time is indicated by line 46. The curve marked 47 in FIG. 9 represents the dynamic holding force of the pole faces over time, which in its timing corresponds to the time response of the diagram of FIG. 8. At time 48, represented as first dashed line, the armature strikes the yoke. The second dashed line 49 represents the time at which the contact base 6 strikes the armature with delay. The swing-back 50 is so small that repeated impingement of the contact base 6 on the armature is precluded. The timing response diagrams indicate the results achieved by the present invention, i.e., the swing-back 50 practically no longer matters, which is different from the known configuration.

What is claimed is:

1. Alternating current contactor comprising:

an armature actuated by a magnet system;

a return spring-loaded contact base;

said armature being in operative connection, via a coupling spring, with said return spring-loaded contact base;

said contact base including a supplementary mass and a supplementary spring that presses the supplementary mass, in a direction opposite to the closing direction of the contact base, against a stop at the contact base; and means for frictionally engaging said supplementary mass to affect the free movement of said supplementary mass.

2. The contactor of claim 1, wherein said means for frictionally engaging said supplementary mass comprises a prestressed cover including portions pressing onto a surface of said supplementary mass.

3. The contactor of claim 1, wherein said means for frictionally engaging said supplementary mass comprises a silicone rubber tube disposed in a groove in said contact base and pressing against said supplementary mass.

4. The contactor of claim 1 wherein said means for frictionally engaging said supplementary mass comprises a silicone rubber tube disposed in a groove in said supplementary mass and pressing against said contact base.

5. The contactor of claim 1, wherein a friction force produced by said means for frictionally engaging is increased dependent on the movement path.

6. The contactor according to claim 5, wherein said means for frictionally engaging comprises a convexly curved leaf spring held at the contact base, a convex part of said leaf spring being pressed in a corresponding recess in said supplementary mass.

7. The contactor of claim 5, wherein said means for frictionally engaging comprises a supplementary mass rotatable about an axle at the contact base, said mass having an elliptically shaped side opposing the pivot point, said supplementary mass being in contact with a leaf spring which is supported in said contact base and which extends in the direction of movement of the contact base.

8. The contactor of claim 4, wherein said means for frictionally engaging comprises an angle spring whose angle is supported at the contact base and which comprises a first leg pressing against a side of said supplementary mass extending parallel to the direction of movement and a second leg forming a supplementary spring.

* * * * *